US008100743B2

(12) United States Patent
Nabeya et al.

(10) Patent No.: US 8,100,743 B2
(45) Date of Patent: Jan. 24, 2012

(54) POLISHING APPARATUS

(75) Inventors: Osamu Nabeya, Tokyo (JP); Tetsuji Togawa, Tokyo (JP); Hozumi Yasuda, Tokyo (JP); Koji Saito, Tokyo (JP); Makoto Fukushima, Tokyo (JP)

(73) Assignee: Ebara Corporation, Tokyo (JP)

( * ) Notice: Subject to any disclaimer, the term of this patent is extended or adjusted under 35 U.S.C. 154(b) by 723 days.

(21) Appl. No.: 12/285,941

(22) Filed: Oct. 16, 2008

(65) Prior Publication Data

US 2009/0111362 A1 Apr. 30, 2009

(30) Foreign Application Priority Data

Oct. 29, 2007 (JP) ..... 2007-280389
May 7, 2008 (JP) ..... 2008-121138

(51) Int. Cl.
*B24B 5/00* (2006.01)

(52) U.S. Cl. ..... 451/286; 451/398

(58) Field of Classification Search ..... 451/285–289, 451/388, 397, 398
See application file for complete search history.

(56) References Cited

U.S. PATENT DOCUMENTS

| | | | | |
|---|---|---|---|---|
| 5,584,751 | A * | 12/1996 | Kobayashi et al. | 451/288 |
| 5,795,215 | A * | 8/1998 | Guthrie et al. | 451/286 |
| 6,428,403 | B1 * | 8/2002 | Kimura et al. | 451/288 |
| 6,767,276 | B2 * | 7/2004 | Keller | 451/328 |
| 7,121,934 | B2 * | 10/2006 | Jung | 451/285 |
| 7,210,991 | B1 | 5/2007 | Van Der Veen et al. | |
| 2006/0128286 | A1 | 6/2006 | Nabeya et al. | |
| 2006/0160479 | A1 | 7/2006 | Chen et al. | |
| 2007/0232193 | A1 | 10/2007 | Yasuda et al. | |
| 2007/0293129 | A1 | 12/2007 | Togawa et al. | |
| 2008/0070479 | A1 | 3/2008 | Nabeya et al. | |
| 2008/0318492 | A1 | 12/2008 | Yasuda et al. | |
| 2008/0318499 | A1 | 12/2008 | Yasuda et al. | |

FOREIGN PATENT DOCUMENTS

| | | |
|---|---|---|
| EP | 1 839 812 | 10/2007 |
| JP | 9-17760 | 1/1997 |
| JP | 9-168968 | 6/1997 |
| JP | 10-180626 | 7/1998 |
| JP | 10-235554 | 9/1998 |
| JP | 11-291162 | 10/1999 |

(Continued)

OTHER PUBLICATIONS

Partial European Search Report dated Oct. 26, 2010 in corresponding European Patent Application No. 08018885.7.

*Primary Examiner* — Dung Van Nguyen
(74) *Attorney, Agent, or Firm* — Wenderoth, Lind & Ponack, L.L.P.

(57) ABSTRACT

A polishing apparatus is used for polishing a substrate such as a semiconductor wafer to a flat mirror finish. The polishing apparatus includes a polishing table having a polishing surface, a top ring body configured to hold and press a substrate against the polishing surface, a retainer ring provided at an outer peripheral portion of the top ring body and configured to press the polishing surface, and a retainer ring guide fixed to the top ring body and configured to be brought into sliding contact with a ring member of the retainer ring to guide a movement of said ring member. Either one of sliding contact surfaces of the ring member and the retainer ring guide which are brought into sliding contact with each other comprises a low friction material.

8 Claims, 14 Drawing Sheets

FOREIGN PATENT DOCUMENTS

| | | |
|---|---|---|
| JP | 2000-52241 | 2/2000 |
| JP | 2000-141211 | 5/2000 |
| JP | 2000-288923 | 10/2000 |
| JP | 2000-301452 | 10/2000 |
| JP | 2000-334656 | 12/2000 |
| JP | 2001-277097 | 10/2001 |
| JP | 2002-96261 | 4/2002 |
| JP | 2002-113653 | 4/2002 |
| JP | 2002-121411 | 4/2002 |
| JP | 2002-200557 | 7/2002 |
| JP | 2003-48155 | 2/2003 |
| JP | 2003-266301 | 9/2003 |
| JP | 2003-311593 | 11/2003 |
| JP | 2004-6653 | 1/2004 |
| JP | 2004-119495 | 4/2004 |
| JP | 2004-276128 | 10/2004 |
| JP | 2005-34959 | 2/2005 |
| JP | 2005-50893 | 2/2005 |
| JP | 2005-169568 | 6/2005 |
| JP | 2006-255851 | 9/2006 |
| JP | 2006-263903 | 10/2006 |
| JP | 2006-324413 | 11/2006 |
| JP | 2006-352108 | 12/2006 |
| JP | 2007-74493 | 3/2007 |
| JP | 2007-158201 | 6/2007 |
| JP | 2007-158255 | 6/2007 |
| WO | 2006/062232 | 6/2006 |
| WO | 2006/090497 | 8/2006 |

* cited by examiner

POLISHING APPARATUS

BACKGROUND OF THE INVENTION

1. Field of the Invention

The present invention relates to a polishing apparatus, and more particularly to a polishing apparatus for polishing an object to be polished (substrate) such as a semiconductor wafer to a flat mirror finish.

2. Description of the Related Art

In recent years, high integration and high density in semiconductor device demands smaller and smaller wiring patterns or interconnections and also more and more interconnection layers. Multilayer interconnections in smaller circuits result in greater steps which reflect surface irregularities on lower interconnection layers. An increase in the number of interconnection layers makes film coating performance (step coverage) poor over stepped configurations of thin films. Therefore, better multilayer interconnections need to have the improved step coverage and proper surface planarization. Further, since the depth of focus of a photolithographic optical system is smaller with miniaturization of a photolithographic process, a surface of the semiconductor device needs to be planarized such that irregular steps on the surface of the semiconductor device will fall within the depth of focus.

Thus, in a manufacturing process of a semiconductor device, it increasingly becomes important to planarize a surface of the semiconductor device. One of the most important planarizing technologies is chemical mechanical polishing (CMP). Thus, there has been employed a chemical mechanical polishing apparatus for planarizing a surface of a semiconductor wafer. In the chemical mechanical polishing apparatus, while a polishing liquid containing abrasive particles such as silica ($SiO_2$) therein is supplied onto a polishing surface such as a polishing pad, a substrate such as a semiconductor wafer is brought into sliding contact with the polishing surface, so that the substrate is polished.

This type of polishing apparatus includes a polishing table having a polishing surface formed by a polishing pad, and a substrate holding device, which is referred to as a top ring or a polishing head, for holding a substrate such as a semiconductor wafer. When a semiconductor wafer is polished with such a polishing apparatus, the semiconductor wafer is held and pressed against the polishing surface under a predetermined pressure by the substrate holding device. At this time, the polishing table and the substrate holding device are moved relative to each other to bring the semiconductor wafer into sliding contact with the polishing surface, so that the surface of the semiconductor wafer is polished to a flat mirror finish.

In such polishing apparatus, if the relative pressing force applied between the semiconductor wafer, being polished, and the polishing surface of the polishing pad is not uniform over the entire surface of the semiconductor wafer, then the surface of the semiconductor wafer is polished insufficiently or excessively in different regions thereof depending on the pressing force applied thereto. It has been customary to uniformize the pressing force applied to the semiconductor wafer by providing a pressure chamber formed by an elastic membrane at the lower portion of the substrate holding device and supplying the pressure chamber with a fluid such as air to press the semiconductor wafer under a fluid pressure through the elastic membrane, as seen in Japanese laid-open patent publication No. 2006-255851.

In this case, the polishing pad is so elastic that pressing forces applied to a peripheral portion of the semiconductor wafer being polished become non-uniform, and hence only the peripheral portion of the semiconductor wafer may excessively be polished, which is referred to as "edge rounding". In order to prevent such edge rounding, the retainer ring for holding the peripheral edge of the semiconductor wafer is vertically movable with respect to the top ring body (or carrier head body) to press an annular portion of the polishing surface of the polishing pad that corresponds to the peripheral portion of the semiconductor wafer by the retainer ring.

In the conventional polishing apparatus, a lateral force (horizontal force) is applied to the retainer ring by a frictional force between the semiconductor wafer and the polishing surface of the polishing pad during polishing, and the lateral force (horizontal force) is received by a retainer ring guide provided at an outer circumferential side of the retainer ring. Therefore, when the retainer ring is vertically moved to follow undulation of the polishing surface of the polishing pad, a large frictional force is generated at sliding contact surfaces of an outer circumferential surface of the retainer ring and an inner circumferential surface of the retainer ring guide. Thus, the following capability of the retainer ring becomes insufficient, and a desired surface pressure of the retainer ring cannot be applied to the polishing surface of the polishing pad.

Further, in order to transmit a rotative force from the top ring (or carrier head) to the retainer ring, a rotary drive unit such as driving pins is provided between the retainer ring and the retainer ring guide. When the retainer ring is vertically moved, a large frictional force is generated at the rotary drive unit. Thus, the following capability of the retainer ring becomes insufficient, and a desired surface pressure of the retainer ring cannot be applied to the polishing surface of the polishing pad.

SUMMARY OF THE INVENTION

The present invention has been made in view of the above drawbacks. It is therefore an object of the present invention to provide a polishing apparatus which can improve the following capability of a retainer ring against a polishing surface, the retainer ring for holding a peripheral edge of a substrate being provided at a peripheral portion of a top ring for holding the substrate, and can apply a desired surface pressure of the retainer ring to the polishing surface.

In order to achieve the above object, according to a first aspect of the present invention, there is provided an apparatus for polishing a substrate, comprising: a polishing table having a polishing surface; a top ring body configured to hold and press a substrate against the polishing surface; a retainer ring provided at an outer peripheral portion of the top ring body and configured to press the polishing surface; and a retainer ring guide fixed to the top ring body and configured to be brought into sliding contact with a ring member of the retainer ring to guide a movement of the ring member; wherein either one of sliding contact surfaces of the ring member and the retainer ring guide which are brought into sliding contact with each other comprises a low friction material.

According to the present invention, because the sliding contact surfaces of the ring member of the retainer ring and the retainer ring guide comprises a low friction material, when the retainer ring is vertically moved to follow undulation of the polishing surface of the polishing table, a frictional force of the sliding contact surfaces (sliding surfaces) of the ring member of the retainer ring and the retainer ring guide can be remarkably reduced to enhance the following capability of the retainer ring with respect to the polishing surface, and a desired surface pressure of the retainer ring can be applied to the polishing surface.

The low friction material is defined as a material having a low coefficient of friction of 0.35 or less. It is desirable that the low friction material has a coefficient of friction of 0.25 or less. The coefficient of friction is dimensionless value under conditions of no lubricating oil. Further, it is desirable that the low friction material comprises a sliding material having high wear resistance.

In a preferred aspect of the present invention, mirror processing is applied to the other of the sliding contact surfaces of the ring member and the retainer ring guide.

According to the present invention, a frictional force of the ring member of the retainer ring and the retainer ring guide can be further reduced.

In a preferred aspect of the present invention, the low friction material comprises a resin material comprising polytetrafluoroethylene (PTFE) or PEEK (polyetheretherketone) •PPS (polyphenylene sulfide). Besides the above resin material, the low friction material may comprise a resin material comprising PET (polyethylene terephthalate), polyethylene, polyamide, polyacetal, polyimide, or polyamide-imide.

In a preferred aspect of the present invention, a metal ring is mounted on the ring member, and the low friction material is provided on an outer circumferential surface of the metal ring.

According to the present invention, since the metal ring made of SUS or the like is fitted over the ring member, the ring member has an improved rigidity. Thus, even if a temperature of the ring member increases due to the sliding contact between the ring member and the polishing surface, thermal deformation of the ring member can be suppressed. Therefore, a clearance between the ring member and the metal ring, and the retainer ring guide can be narrowed, and abnormal noise or vibration generated at the time of collision between the retainer ring guide and the ring member caused by movement of the ring member in the clearance during polishing can be suppressed. Further, since the outer circumferential surface of the metal ring is composed of a low friction material, the sliding characteristics between the ring member and the retainer ring guide can be improved. Thus, the following capability of the ring member with respect to the polishing surface can be remarkably enhanced, and a desired surface pressure of the retainer ring can be applied to the polishing surface.

In a preferred aspect of the present invention, the polishing apparatus further comprises a driving pin for transmitting a rotative force of the top ring body from the retainer ring guide to the ring member; wherein either one of contact surfaces of the driving pin and the ring member comprises a low friction material.

According to the present invention, because a frictional force of the driving pin and the ring member can be reduced to improve the sliding characteristics, the following capability of the ring member with respect to the polishing surface can be remarkably enhanced, and a desired surface pressure of the retainer ring can be applied to the polishing surface. The low friction material is defined as a material having a low coefficient of friction of 0.35 or less. It is desirable that the low friction material has a coefficient of friction of 0.25 or less. Further, it is desirable that the low friction material comprises a sliding material having high wear resistance.

In a preferred aspect of the present invention, mirror processing is applied to the other of the contact surfaces of the driving pin and the ring member.

According to the present invention, a frictional force of the driving pin and the ring member can be further reduced.

In a preferred aspect of the present invention, the low friction material of the contact surface comprises a resin material comprising polytetrafluoroethylene (PTFE) or PEEK•PPS.

According to a second aspect of the present invention, there is provided an apparatus for polishing a substrate, comprising: a polishing table having a polishing surface; a top ring body configured to hold and press a substrate against the polishing surface; a retainer ring provided at an outer peripheral portion of the top ring body and configured to press the polishing surface; and a retainer ring guide fixed to the top ring body and configured to be brought into sliding contact with a ring member of the retainer ring to guide a movement of the ring member; wherein mirror processing is applied to at least one of sliding contact surfaces of the ring member and the retainer ring guide which are brought into sliding contact with each other.

According to the present invention, because mirror processing is applied to the sliding contact surfaces of the ring member of the retainer ring and the retainer ring guide, when the retainer ring is vertically moved to follow undulation of the polishing surface of the polishing table, a frictional force of the sliding contact surfaces of the ring member of the retainer ring and the retainer ring guide can be remarkably reduced to enhance the following capability of the retainer ring with respect to the polishing surface, and a desired surface pressure of the retainer ring can be applied to the polishing surface.

The mirror processing is defined as a processing including polishing, lapping, and buffing. It is desirable that surface roughness achieved by the mirror processing is Ra 0.2 or less.

According to a third aspect of the present invention, there is provided an apparatus for polishing a substrate, comprising: a polishing table having a polishing surface; a top ring body configured to hold and press a substrate against the polishing surface; a retainer ring provided at an outer peripheral portion of the top ring body and configured to press the polishing surface; and a fluid bearing fixed to the top ring body and configured to eject a pressurized fluid to an outer circumferential surface of a ring member of the retainer ring to form a fluid film between the ring member and the fluid bearing.

According to the present invention, when the retainer ring is vertically moved to follow undulation of the polishing surface of the polishing table, the vertically moved ring member of the retainer ring can be supported by the fluid film with no-sliding (noncontact). Thus, the following capability of the retainer ring with respect to the polishing surface can be enhanced, and a desired surface pressure of the retainer ring can be applied to the polishing surface.

In a preferred aspect of the present invention, the fluid bearing comprises a porous member for ejecting the pressurized fluid.

According to the present invention, because the pressurized fluid can be ejected to the ring member of the retainer ring through the porous member having excellent fluid-permeability because of its micropore structure, a fluid film having high load capability can be formed.

In a preferred aspect of the present invention, the pressurized fluid comprises air or nitrogen gas.

In a preferred aspect of the present invention, the porous member comprises metal, ceramics or plastics, and the porous member has a number of pores configured to bring an inner circumferential side of the porous member in communication with an outer circumferential side of the porous member.

In a preferred aspect of the present invention, the fluid bearing comprises a housing configured to house the porous member.

In a preferred aspect of the present invention, the housing has a passage for supplying the pressurized fluid to the porous member.

In a preferred aspect of the present invention, the porous member is impregnated with solid lubricant.

According to the present invention, even if the ring member is brought into contact with the porous member by any chance, the ring member and the porous member maintain excellent sliding characteristics by the solid lubricant.

In a preferred aspect of the present invention, the polishing apparatus further comprises a temperature adjusting device configured to cool the pressurized fluid.

According to the present invention, when the temperature of the ring member of the retainer ring increases by friction heat between the ring member and the polishing surface, the cooled pressurized fluid is blown on the outer circumferential surface of the ring member from the porous member, thus cooling the ring member. The cooled fluid comprises dry air, for example. Therefore, the temperature of the ring member can be prevented from rising to suppress thermal expansion of the ring member. Thus, a clearance between the porous member and the ring member can be minimized, and the pressure of the fluid film formed between the porous member and the ring member can be increased to enhance the effect of the air bearing. Therefore, the ring member of the retainer ring is vertically movable with no-sliding (noncontact) against the porous member, and hence the following capability of the ring member with respect to the polishing surface can be further enhanced.

According to a fourth aspect of the present invention, there is provided an apparatus for polishing a substrate, comprising: a polishing table having a polishing surface; a top ring body configured to hold and press a substrate against the polishing surface; a retainer ring provided at an outer peripheral portion of the top ring body and configured to press the polishing surface; and a retainer ring guide fixed to the top ring body and configured to be brought into sliding contact with a ring member of the retainer ring to guide a movement of the ring member; wherein sliding contact surfaces of the ring member and the retainer ring guide which are brought into sliding contact with each other are coated with liquid or semisolid lubricant; and a connection sheet is provided between an outer circumferential surface of the ring member and the retainer ring guide.

According to the present invention, because the sliding contact surfaces of the ring member of the retainer ring and the retainer ring guide are coated with lubricant, when the retainer ring is vertically moved to follow undulation of the polishing surface of the polishing table, a frictional force of the sliding contact surfaces (sliding surfaces) of the ring member of the retainer ring and the retainer ring guide can be remarkably reduced to enhance the following capability of the retainer ring with respect to the polishing surface, and a desired surface pressure of the retainer ring can be applied to the polishing surface.

Further, according to the present invention, since a connecting sheet is provided between the outer circumferential surface of the ring member and the retainer ring guide at the location below the sliding contact surfaces (lubricant coated surfaces), the lubricant of the sliding contact surfaces can be prevented from falling onto the polishing surface. The lubricant is preferably in the form of liquid or semisolid such as silicon grease or lubricating oil.

According to a fifth aspect of the present invention, there is provided an apparatus for polishing a substrate, comprising: a polishing table having a polishing surface; a top ring body configured to hold and press a substrate against the polishing surface; a retainer ring provided at an outer peripheral portion of the top ring body and configured to press the polishing surface; and a retainer ring guide fixed to the top ring body and configured to be brought into sliding contact with a ring member of the retainer ring to guide a movement of the ring member; wherein a low friction material member is provided on an outer circumference of the ring member of the retainer ring to bring the low friction material member into sliding contact with the retainer ring guide.

According to the present invention, because a low friction material member is provided on an outer circumference of the ring member of the retainer ring, when the retainer ring is vertically moved to follow undulation of the polishing surface of the polishing table, a frictional force of the sliding contact surfaces (sliding surfaces) of the ring member of the retainer ring and the retainer ring guide can be remarkably reduced to enhance the following capability of the retainer ring with respect to the polishing surface, and a desired surface pressure of the retainer ring can be applied to the polishing surface.

The low friction material is defined as a material having a low coefficient of friction of 0.35 or less. It is desirable that the low friction material has a coefficient of friction of 0.25 or less. Further, it is desirable that the low friction material comprises a sliding material having high wear resistance.

In a preferred aspect of the present invention, the low friction material member comprises a resin material comprising polytetrafluoroethylene (PTFE) or PEEK•PPS.

Besides the above resin material, the low friction material may comprise a resin material comprising PET, polyethylene, polyamide, polyacetal, polyimide, or polyamide-imide.

In a preferred aspect of the present invention, the low friction material member is fitted onto an outer circumference of the ring member.

In a preferred aspect of the present invention, the low friction material member comprises a flexible member; and the low friction material member is mounted on the ring member to become a circular shape corresponding to an outer circumference of the ring member.

In a preferred aspect of the present invention, the polishing apparatus further comprises a retaining device provided at a location where the low friction material member is fitted onto the ring member and configured to prevent the low friction material member from dropping out of the ring member.

According to the present invention, a retaining device prevents the low friction material member from dropping out of the ring member of the retainer ring. This retaining device maybe composed of a projection formed in one of the low friction material member and the ring member and a recess formed in the other of the low friction material member and the ring member.

In a preferred aspect of the present invention, the low friction material member comprises a belt-like or block-like member having both ends.

According to the present invention, the low friction material member is composed of not a ring member but divided belt-like or block-like low friction members, and a plurality of belt-like or block-like members are fitted into the ring member of the retainer ring. Thus, the entire circumference of the ring member of the retainer ring is covered with the low friction material member.

In a preferred aspect of the present invention, a plurality of the belt-like or block-like members are provided on an outer circumference of the ring member in such a manner that a clearance is formed between the adjacent belt-like or block-like members.

According to the present invention, when the low friction material member is fitted onto the ring member, a small clearance is formed between the two adjacent low friction material members. This clearance is arranged to prevent the ends of the two adjacent low friction material members from coming into contact with each other, even if the low friction material members are thermally expanded due to temperature rise of the retainer ring as polishing process progresses. The clearance is preferably in the range of about 0.1 mm to about 1 mm in view of thermal expansion coefficient of the low friction material member.

In a preferred aspect of the present invention, the polishing apparatus further comprises a rotation-prevention device configured to prevent the low friction material member from being rotated with respect to the ring member.

According to the present invention, the low friction material member is prevented from being rotated in a circumferential direction of the ring member during polishing. This rotation-prevention device may be composed of a projection formed in one of the low friction material member and the ring member and a recess formed in the other of the low friction material member and the ring member.

According to the present invention, when the retainer ring is vertically moved to follow undulation of the polishing surface of the polishing table, a frictional force of the sliding contact surfaces of the retainer ring and the retainer ring guide can be remarkably reduced to enhance the following capability of the retainer ring with respect to the polishing surface, and a desired surface pressure of the retainer ring can be applied to the polishing surface.

Further, according to the present invention, when the retainer ring is vertically moved to follow undulation of the polishing surface of the polishing table, the vertically moved retainer ring can be supported by the fluid film with no-sliding (noncontact). Thus, the following capability of the retainer ring with respect to the polishing surface can be enhanced, and a desired surface pressure of the retainer ring can be applied to the polishing surface.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
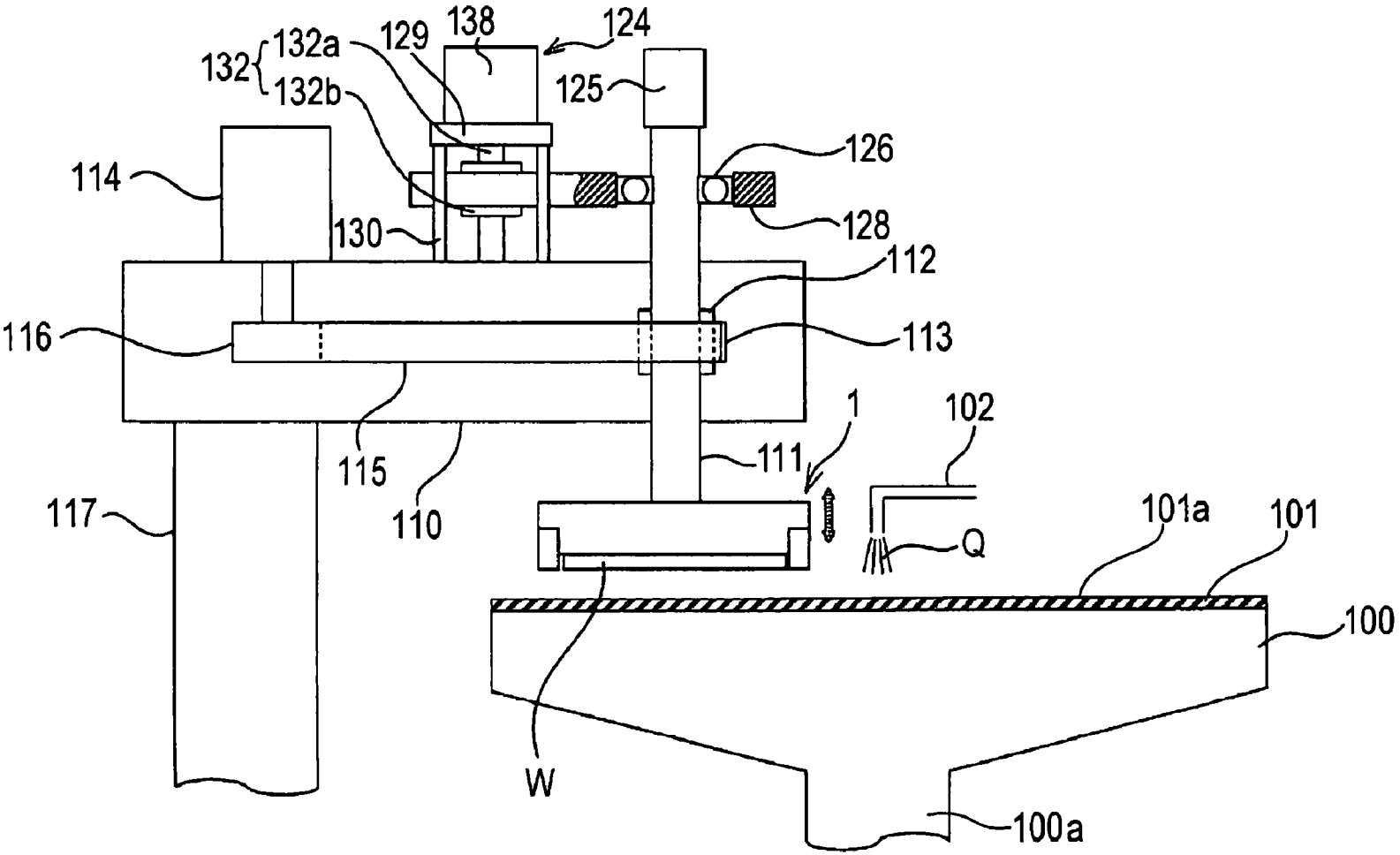
FIG. 1 is a schematic view showing an entire structure of a polishing apparatus according to an embodiment of the present invention.

A polishing apparatus according to embodiments of the present invention will be described below with reference to FIGS. 1 through 14. Like or corresponding parts are denoted by like or corresponding reference numerals throughout drawings and will not be described below repetitively.

FIG. 1 is a schematic view showing an entire structure of the polishing apparatus according to an embodiment of the present invention. As shown in FIG. 1, the polishing apparatus comprises a polishing table 100, and a top ring 1 for holding a substrate such as a semiconductor wafer as an object to be polished and pressing the substrate against a polishing surface on the polishing table 100.

The polishing table 100 is coupled via a table shaft 100a to a motor (not shown) disposed below the polishing table 100. Thus, the polishing table 100 is rotatable about the table shaft 100*a*. A polishing pad 101 is attached to an upper surface of the polishing table 100. An upper surface 101*a* of the polishing pad 101 constitutes a polishing surface to polish a semiconductor wafer W. A polishing liquid supply nozzle 102 is provided above the polishing table 100 to supply a polishing liquid Q onto the polishing pad 101 on the polishing table 100.

The top ring 1 is connected to a lower end of a top ring shaft 111, which is vertically movable with respect to a top ring head 110 by a vertically moving mechanism 124. When the vertically moving mechanism 124 moves the top ring shaft 111 vertically, the top ring 1 is lifted and lowered as a whole for positioning with respect to the top ring head 110. A rotary joint 125 is mounted on the upper end of the top ring shaft 111.

The vertically moving mechanism 124 for vertically moving the top ring shaft 111 and the top ring 1 comprises a bridge 128 on which the top ring shaft 111 is rotatably supported by a bearing 126, a ball screw 132 mounted on the bridge 128, a support base 129 supported by support posts 130, and an AC servomotor 138 mounted on the support base 129. The support base 129, which supports the AC servomotor 138 thereon, is fixedly mounted on the top ring head 110 by the support posts 130.

The ball screw 132 comprises a screw shaft 132*a* coupled to the AC servomotor 138 and a nut 132b threaded over the screw shaft 132*a*. The top ring shaft 111 is vertically movable in unison with the bridge 128 by the vertically moving mechanism 124. When the AC servomotor 138 is energized, the bridge 128 moves vertically via the ball screw 132, and the top ring shaft 111 and the top ring 1 move vertically.

The top ring shaft 111 is connected to a rotary sleeve 112 by a key (not shown). The rotary sleeve 112 has a timing pulley 113 fixedly disposed therearound. A top ring motor 114 having a drive shaft is fixed to the top ring head 110. The timing pulley 113 is operatively coupled to a timing pulley 116 mounted on the drive shaft of the top ring motor 114 by a timing belt 115. When the top ring motor 114 is energized, the timing pulley 116, the timing belt 115, and the timing pulley 113 are rotated to rotate the rotary sleeve 112 and the top ring shaft 111 in unison with each other, thus rotating the top ring 1. The top ring head 110 is supported on a top ring head shaft 117 fixedly supported on a frame (not shown).

In the polishing apparatus constructed as shown in FIG. 1, the top ring 1 is configured to hold the substrate such as a semiconductor wafer W on its lower surface. The top ring head 110 is pivotable (swingable) about the top ring head shaft 117. Thus, the top ring 1, which holds the semiconductor wafer W on its lower surface, is moved between a position at which the top ring 1 receives the semiconductor wafer W and a position above the polishing table 100 by pivotal movement of the top ring head 110. The top ring 1 is lowered to press the semiconductor wafer W against a surface (polishing surface) 101*a* of the polishing pad 101. At this time, while the top ring 1 and the polishing table 100 are respectively rotated, a polishing liquid is supplied onto the polishing pad 101 by the polishing liquid supply nozzle 102 provided above the polishing table 100. The semiconductor wafer W is brought into sliding contact with the polishing surface 101*a* of the polishing pad 101. Thus, a surface of the semiconductor wafer W is polished.

FIGS. 2 through 6 are cross-sectional views showing an example of the top ring 1 along a plurality of radial directions of the top ring 1.

Figure 2:
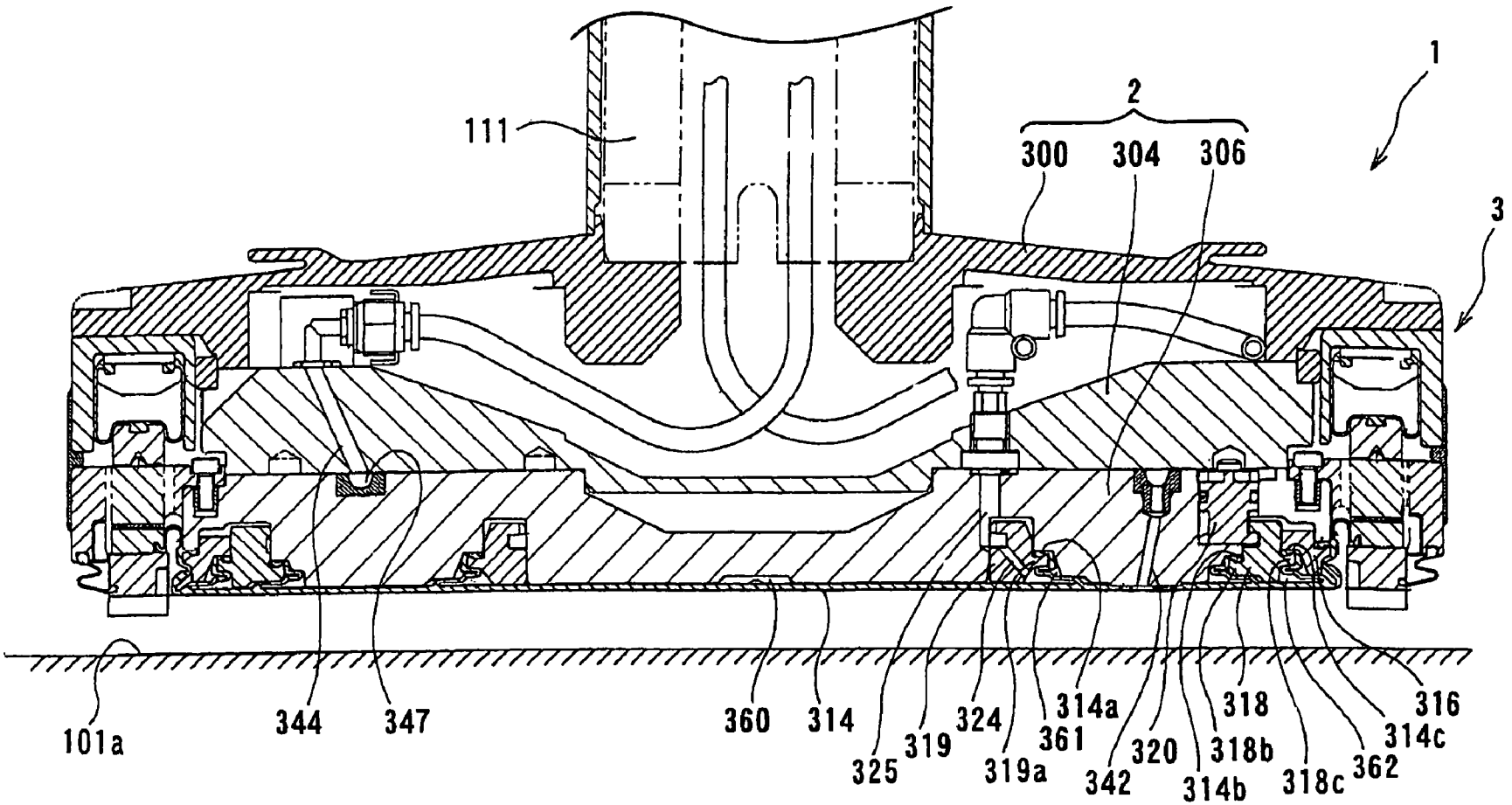
FIG. 2 is a cross-sectional view showing a top ring shown in FIG. 1.
Figure 3:
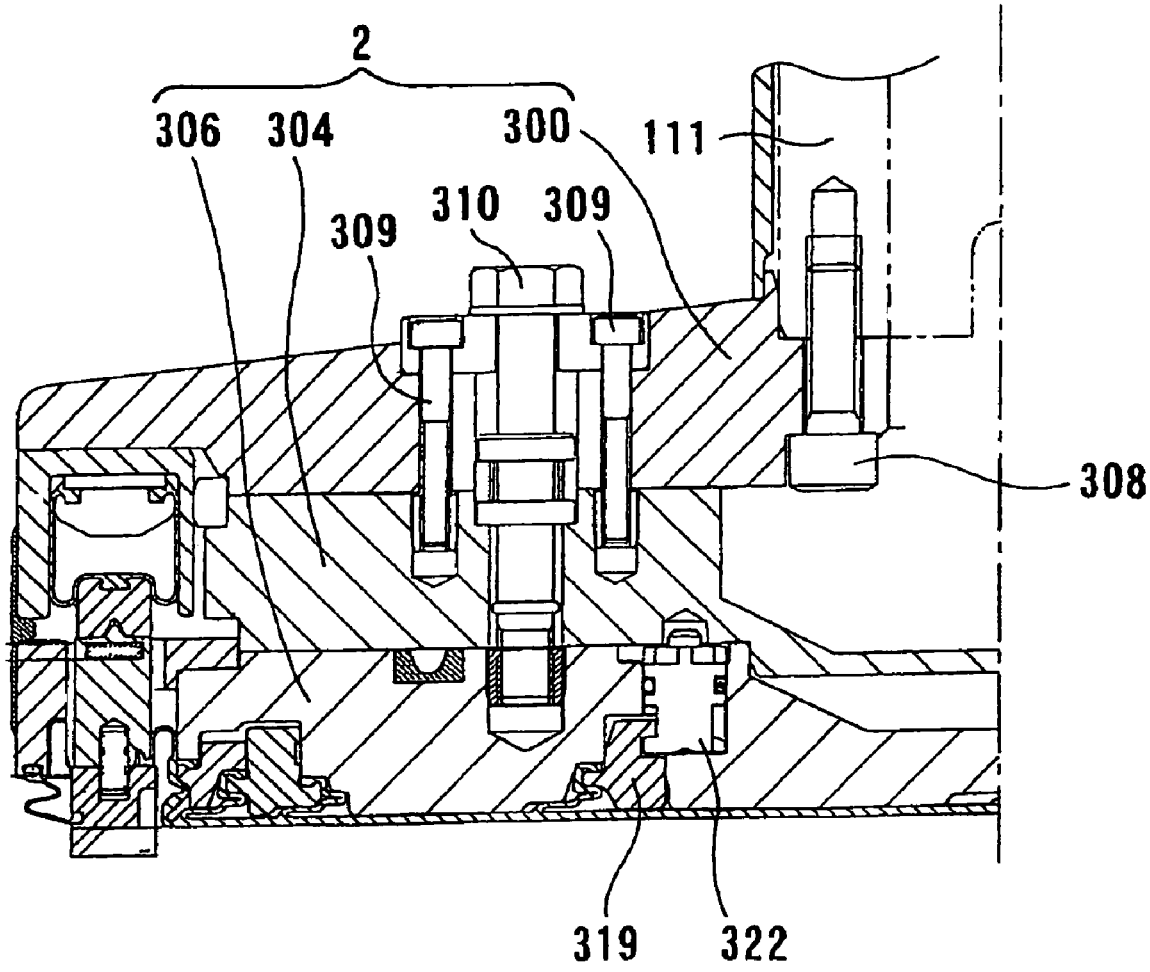
FIG. 3 is a cross-sectional view showing the top ring shown in FIG. 1.

As shown in FIGS. 2 through 6, the top ring 1 basically comprises a top ring body 2 for pressing a semiconductor wafer W against the polishing surface 101*a*, and a retainer ring 3 for directly pressing the polishing surface 101*a*. The top ring body 2 includes an upper member 300 in the form of a circular plate, an intermediate member 304 attached to a lower surface of the upper member 300, and a lower member 306 attached to a lower surface of the intermediate member 304. The retainer ring 3 is attached to a peripheral portion of the upper member 300. As shown in FIG. 3, the upper member 300 is connected to the top ring shaft 111 by bolts 308. Further, the intermediate member 304 is fixed to the upper member 300 by bolts 309, and the lower member 306 is fixed to the upper member 300 by bolts 310. The top ring body 2 comprising the upper member 300, the intermediate member 304, and the lower member 306 is made of resin such as engineering plastics (e.g., PEEK).

As shown in FIG. 2, the top ring 1 has an elastic membrane 314 attached to a lower surface of the lower member 306. The elastic membrane 314 is brought into contact with a rear face of a semiconductor wafer held by the top ring 1. The elastic membrane 314 is held on the lower surface of the lower member 306 by an annular edge holder 316 disposed radially outward and annular ripple holders 318 and 319 disposed radially inward of the edge holder 316. The elastic membrane 314 is made of a highly strong and durable rubber material such as ethylene propylene rubber (EPDM), polyurethane rubber, silicone rubber, or the like.

The edge holder 316 is held by the ripple holder 318, and the ripple holder 318 is held on the lower surface of the lower member 306 by a plurality of stoppers 320. As shown in FIG. 3, the ripple holder 319 is held on the lower surface of the lower member 306 by a plurality of stoppers 322. The stoppers 320 and the stoppers 322 are arranged along a circumferential direction of the top ring 1 at equal intervals.

As shown in FIG. 2, a central chamber 360 is formed at a central portion of the elastic membrane 314. The ripple holder 319 has a passage 324 communicating with the central chamber 360. The lower member 306 has a passage 325 communicating with the passage 324. The passage 324 of the ripple holder 319 and the passage 325 of the lower member 306 are connected to a fluid supply source (not shown). Thus, a pressurized fluid is supplied through the passages 325 and 324 to the central chamber 360 formed by the elastic membrane 314.

The ripple holder 318 has claws 318*b* and 318*c* for pressing a ripple 314*b* and an edge 314*c* of the elastic membrane 314 against the lower surface of the lower member 306. The ripple holder 319 has a claw 319*a* for pressing a ripple 314*a* of the elastic membrane 314 against the lower surface of the lower member 306.

Figure 4:
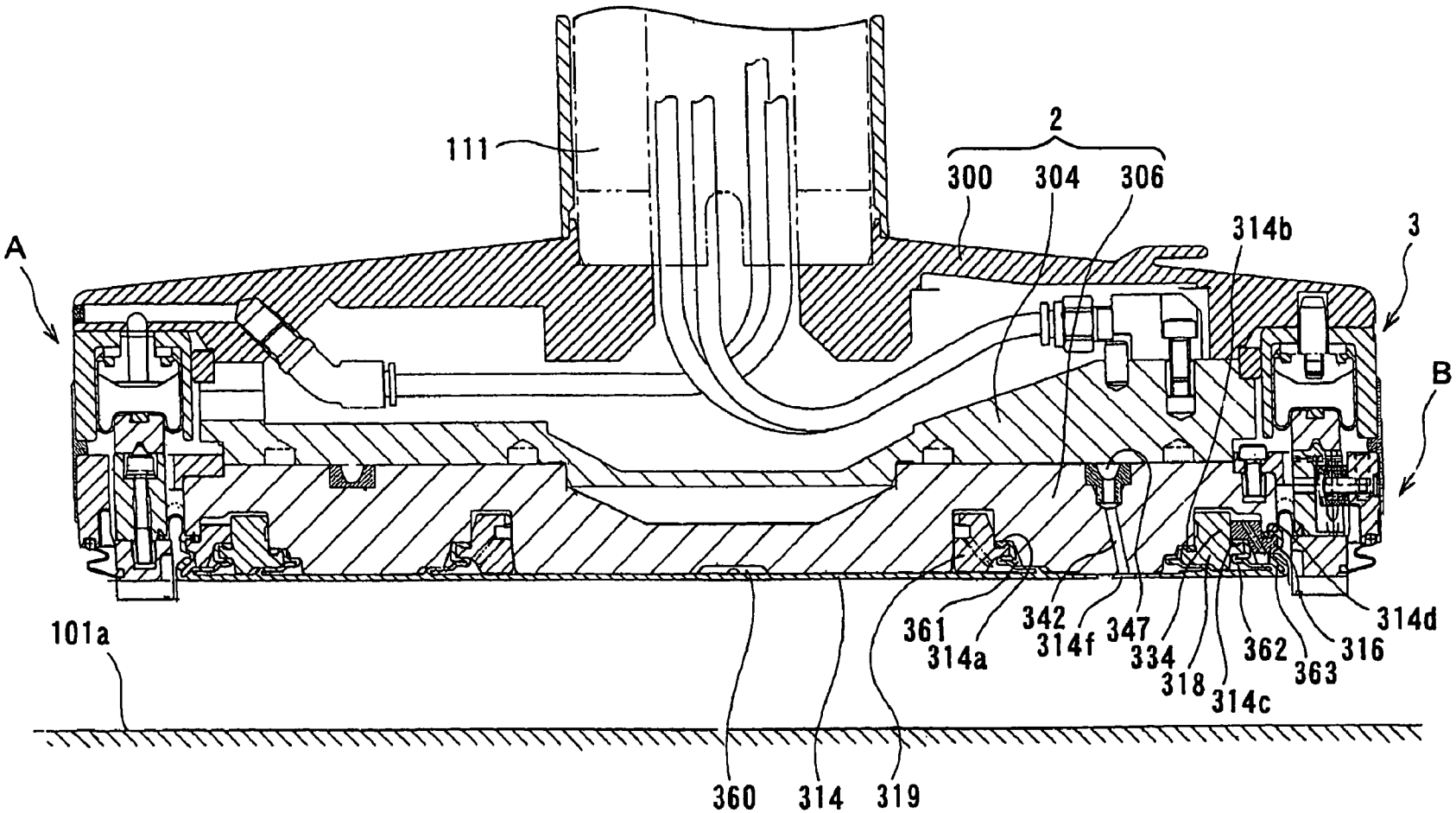
FIG. 4 is a cross-sectional view showing the top ring shown in FIG. 1.

As shown in FIG. 4, an annular ripple chamber 361 is formed between the ripple 314*a* and the ripple 314*b* of the elastic membrane 314. A gap 314*f* is formed between the ripple holder 318 and the ripple holder 319 of the elastic membrane 314. The lower member 306 has a passage 342 communicating with the gap 314*f*. Further, as shown in FIG. 2, the intermediate member 304 has a passage 344 communicating with the passage 342 of the lower member 306. An annular groove 347 is formed at a connecting portion between the passage 342 of the lower member 306 and the passage 344 of the intermediate member 304. The passage 342 of the lower member 306 is connected via the annular groove 347 and the passage 344 of the intermediate member 304 to a fluid supply source (not shown). Thus, a pressurized fluid is supplied through these passages to the ripple chamber 361. Further, the passage 342 is selectively connected to a vacuum pump (not shown). When the vacuum pump is operated, a semiconductor wafer is attracted to the lower surface of the elastic membrane 314 by suction, thereby chucking the semiconductor wafer.

Figure 5:
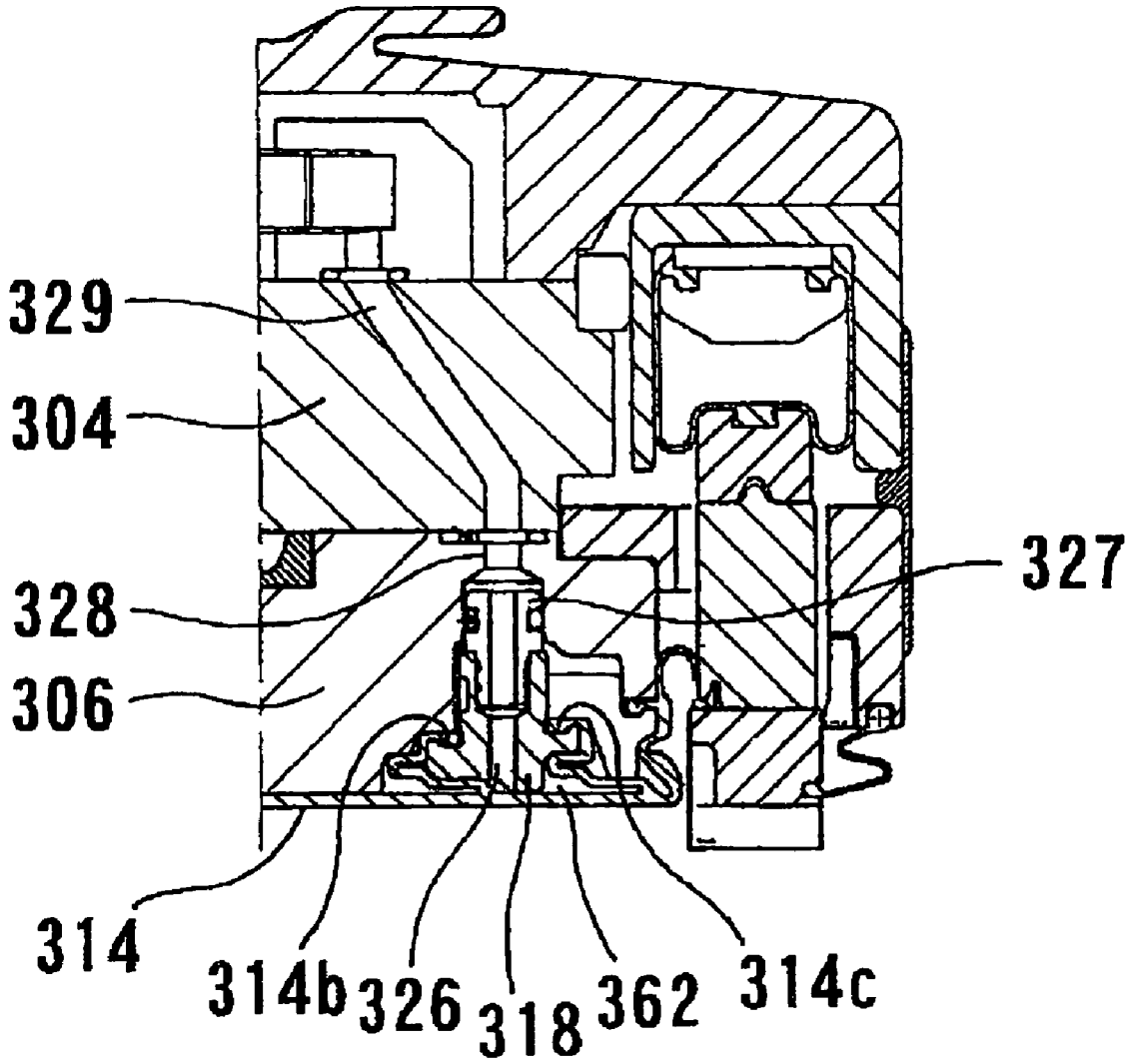
FIG. 5 is a cross-sectional view showing the top ring shown in FIG. 1.

As shown in FIG. 5, the ripple holder 318 has a passage 326 communicating with an annular outer chamber 362 formed by the ripple 314*b* and the edge 314*c* of the elastic membrane 314. Further, the lower member 306 has a passage 328 communicating with the passage 326 of the ripple holder 318 via a connector 327. The intermediate member 304 has a passage 329 communicating with the passage 328 of the lower member 306. The passage 326 of the ripple holder 318 is connected via the passage 328 of the lower member 306 and the passage 329 of the intermediate member 304 to a fluid supply source (not shown). Thus, a pressurized fluid is supplied through these passages to the outer chamber 362 formed by the elastic membrane 314.

Figure 6:
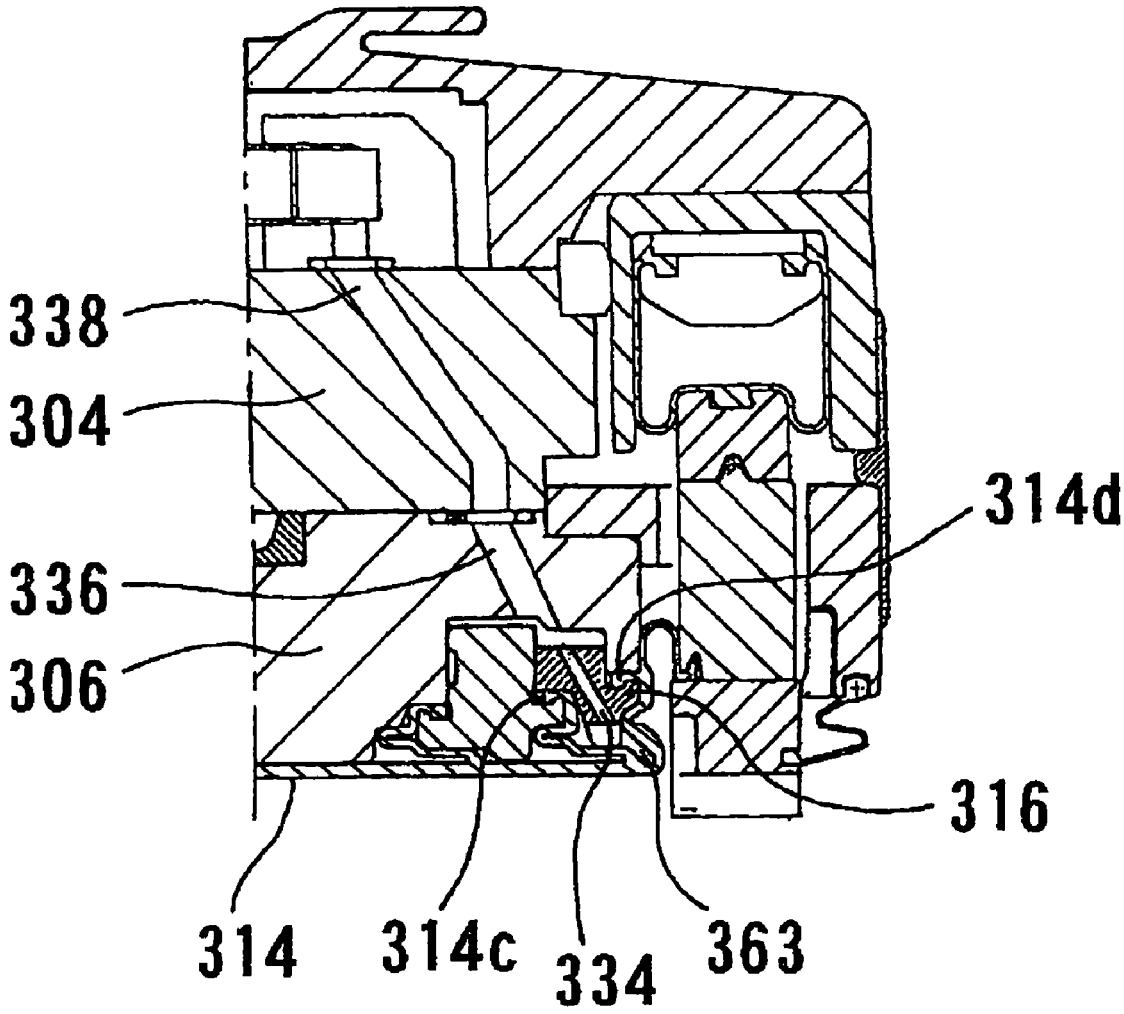
FIG. 6 is a cross-sectional view showing the top ring shown in FIG. 1.

As shown in FIG. 6, the edge holder 316 has a claw for holding an edge 314*d* of the elastic membrane 314 on the lower surface of the lower member 306. The edge holder 316 has a passage 334 communicating with an annular edge chamber 363 formed by the edges 314*c* and 314*d* of the elastic membrane 314. The lower member 306 has a passage 336 communicating with the passage 334 of the edge holder 316. The intermediate member 304 has a passage 338 communicating with the passage 336 of the lower member 306. The passage 334 of the edge holder 316 is connected via the passage 336 of the lower member 306 and the passage 338 of the intermediate member 304 to a fluid supply source (not shown). Thus, a pressurized fluid is supplied through these passages to the edge chamber 363 formed by the elastic membrane 314.

As described above, in the top ring 1 according to the present embodiment, pressing forces for pressing a semiconductor wafer against the polishing pad 101 can be adjusted at local areas of the semiconductor wafer by adjusting pressures of fluids to be supplied to the respective pressure chambers formed between the elastic membrane 314 and the lower member 306 (i.e., the central chamber 360, the ripple chamber 361, the outer chamber 362, and the edge chamber 363).

Figure 7:
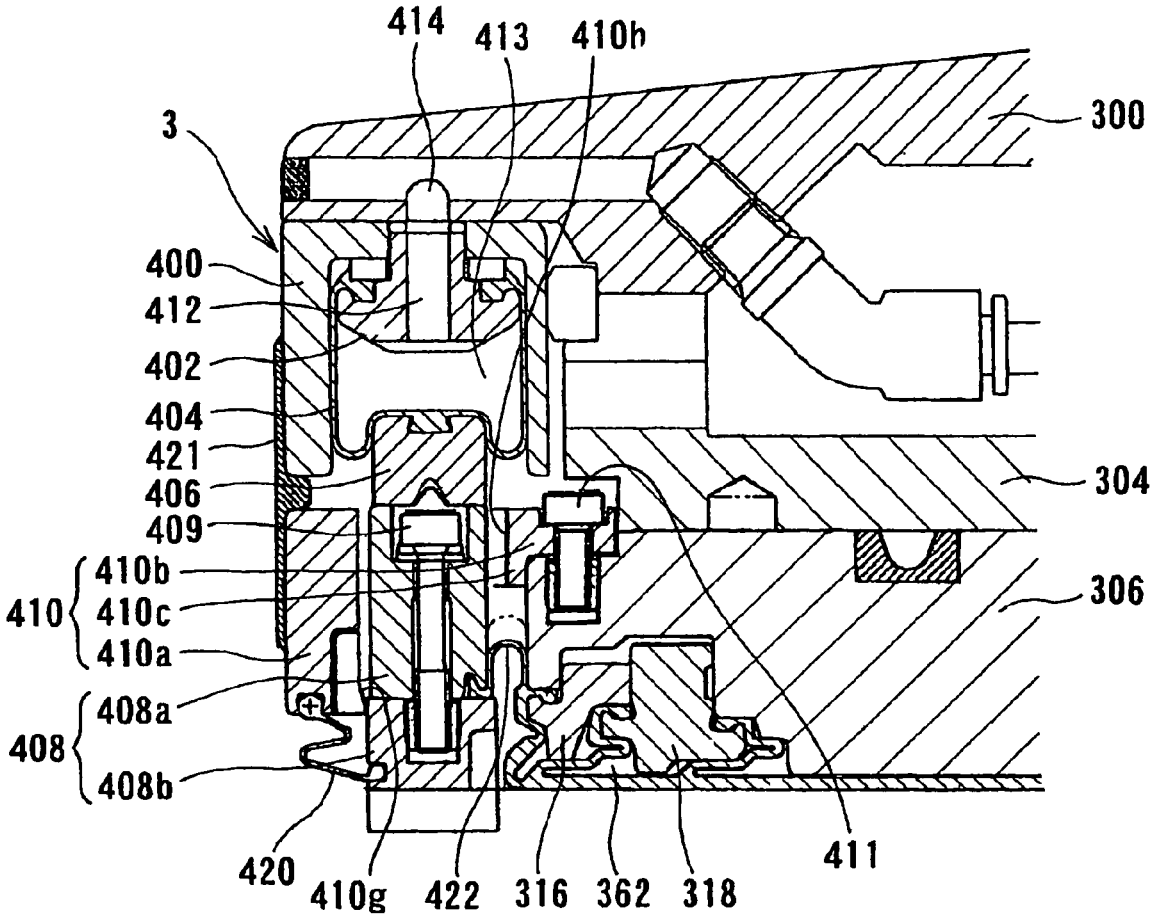
FIG. 7 is an enlarged view of A part of a retainer ring shown in FIG. 4.

FIG. 7 is an enlarged view of the retainer ring 3 shown in FIG. 4. The retainer ring 3 serves to hold a peripheral edge of a semiconductor wafer. As shown in FIG. 7, the retainer ring 3 comprises a cylinder 400 having a cylindrical shape with a closed upper end, a holder 402 attached to an upper portion of the cylinder 400, an elastic membrane 404 held in the cylinder 400 by the holder 402, a piston 406 connected to a lower end of the elastic membrane 404, and a ring member 408 which is pressed downward by the piston 406.

The ring member 408 comprises an upper ring member 408*a* coupled to the piston 406, and a lower ring member 408*b* which is brought into contact with the polishing surface 101. The upper ring member 408*a* and the lower ring member 408*b* are coupled by a plurality of bolts 409. The upper ring member 408*a* is composed of a metal material such as SUS or a material such as ceramics, and the lower ring member 408*b* is made of a resin material such as PEEK or PPS.

As shown in FIG. 7, the holder 402 has a passage 412 communicating with a chamber 413 formed by the elastic membrane 404. The upper member 300 has a passage 414 communicating with the passage 412 of the holder 402. The passage 412 of the holder 402 is connected via the passage 414 of the upper member 300 to a fluid supply source (not shown). Thus, a pressurized fluid is supplied through the passages 414 and 412 to the chamber 413. Accordingly, by adjusting a pressure of the fluid to be supplied to the pressure chamber 413, the elastic membrane 404 can be expanded and contracted so as to vertically move the piston 406. Thus, the ring member 408 of the retainer ring 3 can be pressed against the polishing pad 101 under a desired pressure.

In the illustrated example, the elastic membrane 404 employs a rolling diaphragm formed by an elastic membrane having bent portions. When an inner pressure in a chamber defined by the rolling diaphragm is changed, the bent portions of the rolling diaphragm are rolled so as to widen the chamber. The diaphragm is not brought into sliding contact with outside components and is hardly expanded and contracted when the chamber is widened. Accordingly, friction due to sliding contact can extremely be reduced, and a lifetime of the diaphragm can be prolonged. Further, pressing forces under which the retainer ring 3 presses the polishing pad 101 can accurately be adjusted.

With the above arrangement, only the ring member 408 of the retainer ring 3 can be lowered. Accordingly, a constant distance can be maintained between the lower member 306 and the polishing pad 101 even if the ring member 408 of the retainer ring 3 is worn out. Further, since the ring member 408, which is brought into contact with the polishing pad 101, and the cylinder 400 are connected by the deformable elastic membrane 404, no bending moment is produced by offset loads. Thus, surface pressures by the retainer ring 3 can be made uniform, and the retainer ring 3 becomes more likely to follow the polishing pad 101.

Further, as shown in FIG. 7, the retainer ring 3 has a ring-shaped retainer ring guide 410 for guiding vertical movement of the ring member 408. The ring-shaped retainer ring guide 410 comprises an outer peripheral portion 410*a* located at an outer circumferential side of the ring member 408 so as to surround an entire circumference of an upper portion of the ring member 408, an inner peripheral portion 410*b* located at an inner circumferential side of the ring member 408, and an intermediate portion 410*c* configured to connect the outer peripheral portion 410*a* and the inner peripheral portion 410*b*. The inner peripheral portion 410*b* of the retainer ring guide 410 is fixed to the lower member 306 of the top ring 1 by a plurality of bolts 411. The intermediate portion 410*c* configured to connect the outer peripheral portion 410*a* and the inner peripheral portion 410*b* has a plurality of openings 410*h* which are formed at equal intervals in a circumferential direction of the intermediate portion 410*c*.

Figure 8:
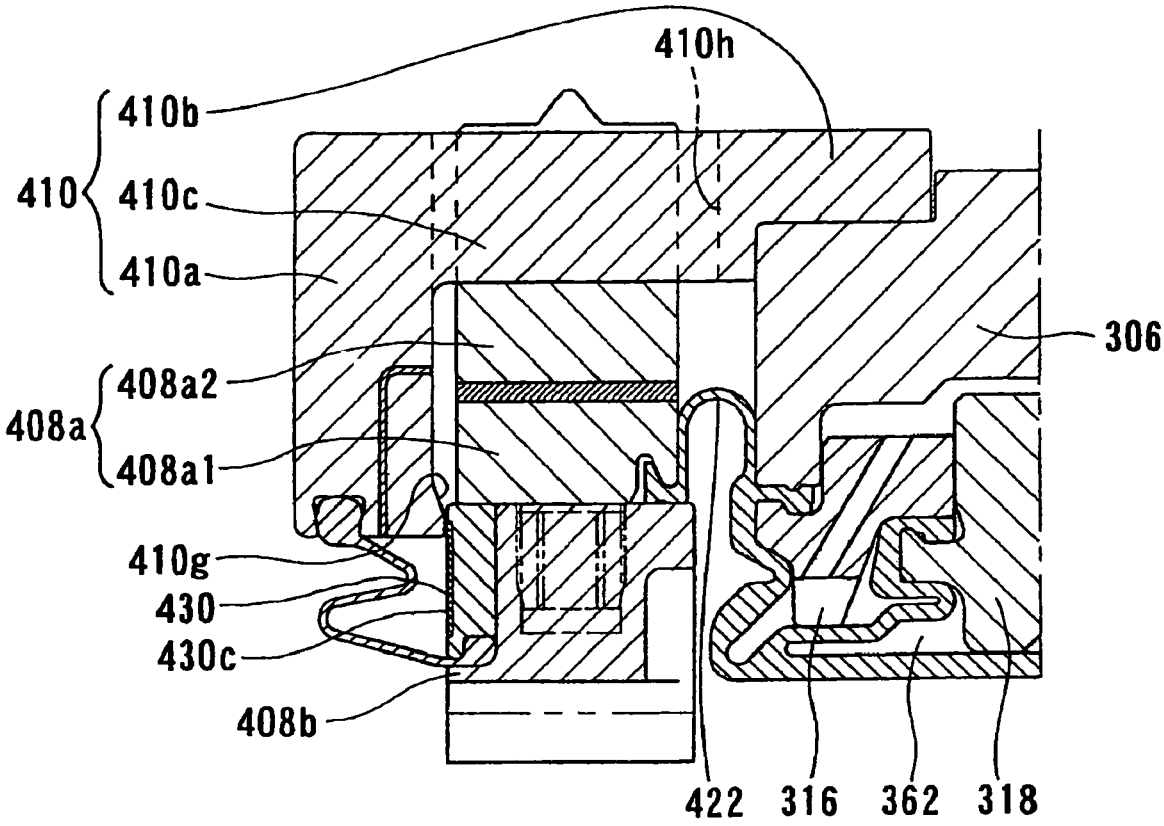
FIG. 8 is a view showing the configuration of a retainer ring guide and a ring member.

FIG. 8 shows the configuration of the retainer ring guide 410 and the ring member 408. As shown in FIG. 8, the intermediate portion 410*c* is in the form of a ring as an entirely circumferentially continuous element, and has a plurality of circular arc openings 410*h* formed at equal intervals in a circumferential direction of the intermediate portion 410*c*. In FIG. 8, the circular arc opening 410*h* is shown by dotted lines.

On the other hand, the upper ring 408*a* of the ring member 408 comprises a lower ring portion 408*a*1 in the form of a ring as an entirely circumferentially continuous element, and a plurality of upper circular arc portions 408*a*2 projecting upwardly at equal intervals in a circumferential direction from the lower ring portion 408*a*1. Each of the upper circular arc portions 408*a*2 passes through the circular arc opening 410*h* and is coupled to the piston 406 (see FIG. 7).

As shown in FIG. 8, a thin metal ring 430 made of SUS or the like is fitted over the lower ring member 408*b*. A coating layer 430*c* made of a resin material such as PEEK•PPS filled with a filler such as polytetrafluoroethylene (PTFE) or PTFE is formed on an outer circumferential surface of the metal ring 430. The resin material such as PTFE or PEEK•PPS comprises a low friction material having a low coefficient of friction, and has excellent sliding characteristics. The low friction material is defined as a material having a low coefficient of friction of 0.35 or less. It is desirable that the low friction material has a coefficient of friction of 0.25 or less.

On the other hand, the inner circumferential surface of the outer peripheral portion 410*a* of the retainer ring guide 410 constitutes a guide surface 410*g* which is brought into sliding contact with the coating layer 430*c*. The guide surface 410*g* has an improved surface roughness by mirror processing. The mirror processing is defined as a processing including polishing, lapping, and buffing.

As shown in FIG. 8, since the metal ring 430 made of SUS or the like is fitted over the lower ring member 408*b*, the lower ring member 408*b* has an improved rigidity. Thus, even if a temperature of the ring member 408*b* increases due to the sliding contact between the ring member 408*b* and the polishing surface 101*a*, thermal deformation of the lower ring member 408*b* can be suppressed. Therefore, a clearance between outer circumferential surfaces of the metal ring 430 and the lower ring member 408*b* and an inner circumferential surface of the outer peripheral portion 410*a* of the retainer ring guide 410 can be narrowed, and abnormal noise or vibration generated at the time of collision between the retainer ring guide 410 and the ring member 408 caused by movement of the ring member 408 in the clearance can be suppressed. Further, since the coating layer 430*c* formed on the outer circumferential surface of the metal ring 430 is composed of a low friction material, and the guide surface 410*g* of the retainer ring guide 410 has an improved surface roughness by mirror processing, the sliding characteristics between the lower ring member 408*b* and the retainer ring guide 410 can be improved. Thus, the following capability of the ring member 408 with respect to the polishing surface can be remarkably enhanced, and a desired surface pressure of the retainer ring can be applied to the polishing surface.

In the embodiment shown in FIG. 8, the metal ring 430 is coated with a low friction material such as PTFE or PEEK•PPS. However, a low friction material such as PTFE or PEEK•PPS may be directly provided on the outer circumferential surface of the lower ring member 408*b* by coating or adhesive. Further, a ring-shaped low friction material may be provided on the outer circumferential surface of the lower ring member 408*b* by double-faced tape. Further, the low friction material may be provided on the retainer ring guide 410, and mirror processing may be applied to the lower ring member 408*b*.

Further, both of the sliding contact surfaces of the retainer ring guide 410 and the lower ring member 408*b* may be subjected to mirror processing to improve sliding characteristics between the lower ring member 408*b* and the retainer ring guide 410. In this manner, by applying mirror processing to both of the sliding contact surfaces of the retainer ring guide 410 and the lower ring member 408*b*, the following capability of the ring member 408 with respect to the polishing surface can be remarkably enhanced, and a desired surface pressure of the retainer ring can be applied to the polishing surface.

Further, the sliding contact surfaces of the lower ring member 408*b* of the retainer ring 3 and the retainer ring guide 410 may be coated with liquid or semisolid lubricant to improve the sliding characteristics between the lower ring member 408*b* of the retainer ring 3 and the retainer ring guide 410. In this manner, in the case where the sliding contact surfaces of the lower ring member 408*b* of the retainer ring 3 and the retainer ring guide 410 are coated with lubricant, when the retainer ring 3 is vertically moved to follow undulation of the polishing surface of the polishing table, a frictional force of the sliding contact surfaces of the lower ring member 408*b* of the retainer ring 3 and the retainer ring guide 410 can be remarkably reduced to enhance the following capability of the retainer ring 3 with respect to the polishing surface, and a desired surface pressure of the retainer ring 3 can be applied to the polishing surface.

Further, according to the present invention, since a connecting sheet 420 is provided between the outer circumferential surface of the lower ring member 408*b* and the retainer ring guide 410 at the location below the sliding contact surfaces (lubricant coated surfaces), the lubricant of the sliding contact surfaces can be prevented from falling onto the polishing surface. The lubricant is preferably in the form of liquid or semisolid such as silicon grease or lubricating oil.

Figure 9:
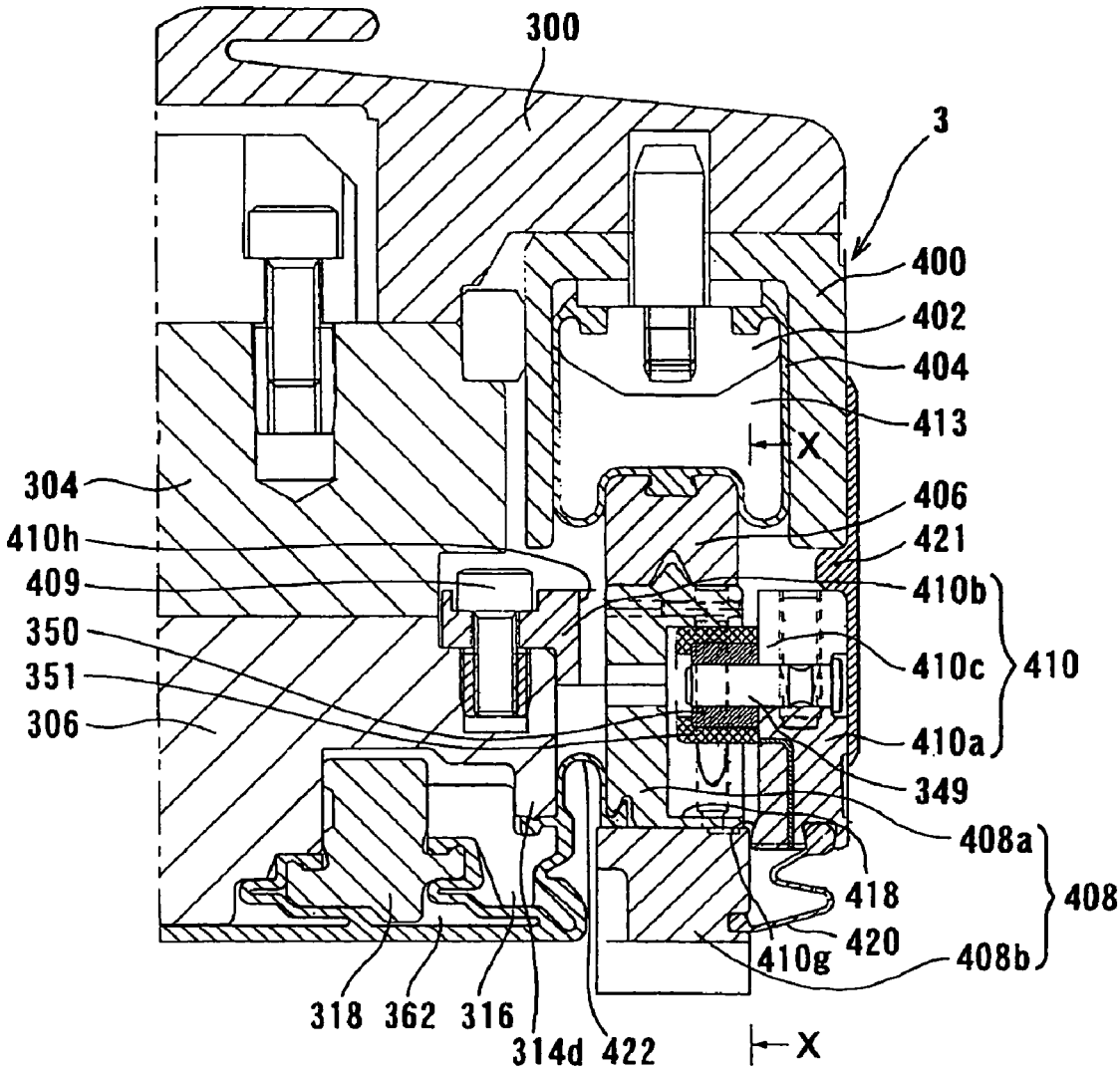
FIG. 9 is an enlarged view of B part of the retainer ring shown in FIG. 4.
Figure 10:
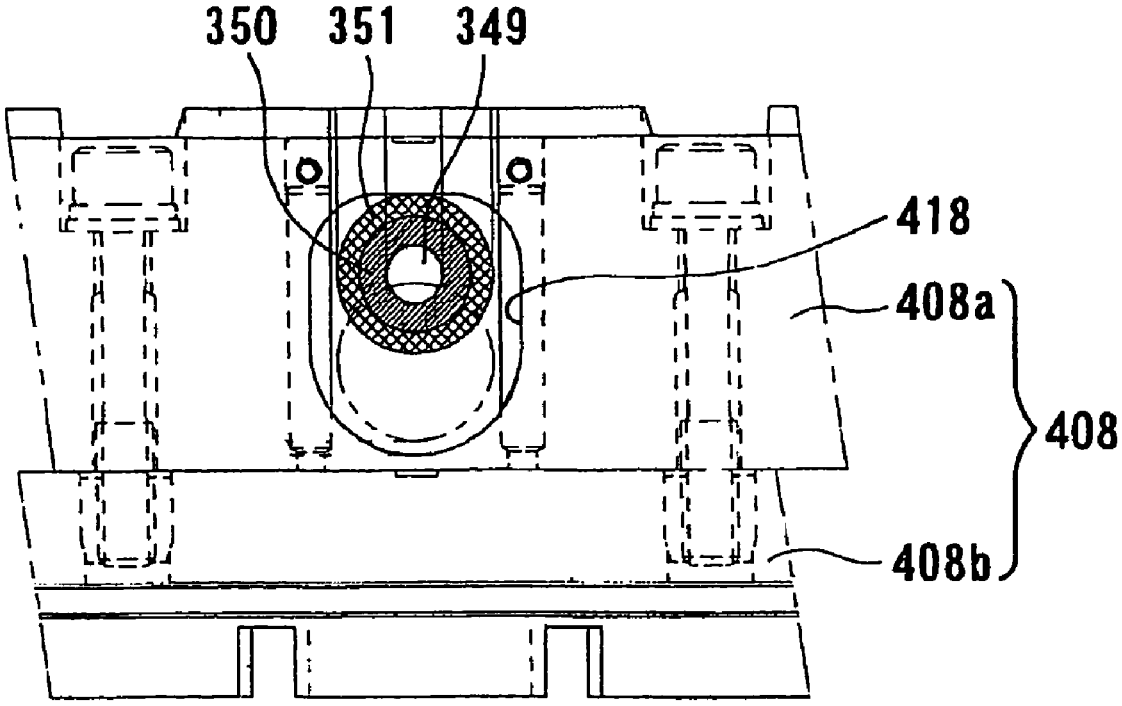
FIG. 10 is a view as viewed from line X-X of FIG. 9.

FIG. 9 is an enlarged view of B part of the retainer ring shown in FIG. 4, and FIG. 10 is a view as viewed from line X-X of FIG. 9. As shown in FIGS. 9 and 10, substantially oblong grooves 418 extending vertically are formed in the outer circumferential surface of the upper ring member 408*a* of the ring member 408 of the retainer ring 3. A plurality of oblong grooves 418 are formed at equal intervals in the outer circumferential surface of the upper ring member 408*a*. Further, a plurality of driving pins 349 projecting radially inwardly are provided on the outer peripheral portion 410*a* of the retainer ring guide 410. The driving pins 349 are configured to be engaged with the oblong grooves 418 of the ring member 408, respectively. The ring member 408 and the driving pin 349 are slidable vertically relative to each other in the oblong groove 418, and the rotation of the top ring body 2 is transmitted through the upper member 300 and the retainer ring guide 410 to the retainer ring 3 by the driving pins 349 to rotate the top ring body 2 and the retainer ring 3 integrally. A rubber cushion 350 is provided on the outer circumferential surface of the driving pin 349, and a collar 351 made of a low friction material such as PTFE or PEEK•PPS is provided on the rubber cushion 350. Further, mirror processing is applied to the inner surface of the oblong groove 418 to improve surface roughness of the inner surface of the oblong groove 418 with which the collar 351 made of a low friction material is bought into sliding contact.

In this manner, according to the present embodiment, the collar 351 made of the low friction material is provided on the driving pin 349, and mirror processing is applied to the inner surface of the oblong groove 418 with which the collar 351 is brought into sliding contact, thus enhancing the sliding characteristics between the driving pin 349 and the ring member 408. Therefore, the following capability of the ring member 408 with respect to the polishing surface can be remarkably enhanced, and a desired surface pressure of the retainer ring can be applied to the polishing surface. Mirror processing maybe applied to the driving pin 349 and a low friction material may be provided on the oblong groove 418 of the ring member 408 with which the driving pin 349 is engaged.

As shown in FIGS. 2 through 9, a connection sheet 420, which can be expanded and contracted in a vertical direction, is provided between an outer circumferential surface of the ring member 408 and a lower end of the retainer ring guide 410. The connection sheet 420 is disposed so as to fill a gap between the ring member 408 and the retainer ring guide 410. Thus, the connection sheet 420 serves to prevent a polishing liquid (slurry) from being introduced into the gap between the ring member 408 and the retainer ring guide 410. A band 421 comprising a belt-like flexible member is provided between an outer circumferential surface of the cylinder 400 and an outer circumferential surface of the retainer ring guide 410. The band 421 is disposed so as to cover a gap between the cylinder 400 and the retainer ring guide 410. Thus, the band 421 serves to prevent a polishing liquid (slurry) from being introduced into the gap between the cylinder 400 and the retainer ring guide 410.

The elastic membrane 314 includes a seal portion 422 connecting the elastic membrane 314 to the retainer ring 3 at an edge (periphery) 314*d* of the elastic membrane 314. The seal portion 422 has an upwardly curved shape. The seal portion 422 is disposed so as to fill a gap between the elastic membrane 314 and the ring member 408. The seal portion 422 is made of a deformable material. The seal portion 422 serves to prevent a polishing liquid from being introduced into the gap between the elastic membrane 314 and the ring member 408 while allowing the top ring body 2 and the retainer ring 3 to be moved relative to each other. In the present embodiment, the seal portion 422 is formed integrally with the edge 314*d* of the elastic membrane 314 and has a U-shaped cross-section.

If the connection sheet 420, the band 421 and the seal portion 422 are not provided, a polishing liquid may be introduced into an interior of the top ring 1 so as to inhibit normal operation of the top ring body 2 and the retainer ring 3 of the top ring 1. In the present embodiment, the connection sheet 420, the band 421 and the seal portion 422 prevent a polishing liquid from being introduced into the interior of the top ring 1. Accordingly, it is possible to operate the top ring 1 normally. The elastic membrane 404, the connection sheet 420, and the seal portion 422 are made of a highly strong and durable rubber material such as ethylene propylene rubber (EPDM), polyurethane rubber, silicone rubber, or the like.

In the top ring 1 according to the present embodiment, pressing forces to press a semiconductor wafer against a polishing surface are controlled by pressures of fluids to be supplied to the central chamber 360, the ripple chamber 361, the outer chamber 362, and the edge chamber 363 formed by the elastic membrane 314. Accordingly, the lower member 306 should be located away upward from the polishing pad 101 during polishing. However, if the retainer ring 3 is worn out, a distance between the semiconductor wafer and the lower member 306 is varied to change a deformation manner of the elastic membrane 314. Thus, surface pressure distribution is also varied on the semiconductor wafer. Such a variation of the surface pressure distribution causes unstable profiles of polished semiconductor wafers.

In the illustrated example, since the retainer ring 3 can vertically be moved independently of the lower member 306, a constant distance can be maintained between the semiconductor wafer and the lower member 306 even if the ring member 408 of the retainer ring 3 is worn out. Accordingly, profiles of polished semiconductor wafers can be stabilized.

In the illustrated example, the elastic membrane 314 is disposed so as to be brought into contact with substantially the entire surface of the semiconductor wafer. However, the elastic membrane 314 may be brought into contact with at least a portion of a semiconductor wafer.

Next, a top ring according to another embodiment of the present invention will be described with reference to FIGS. 11 and 12.

Figure 11:
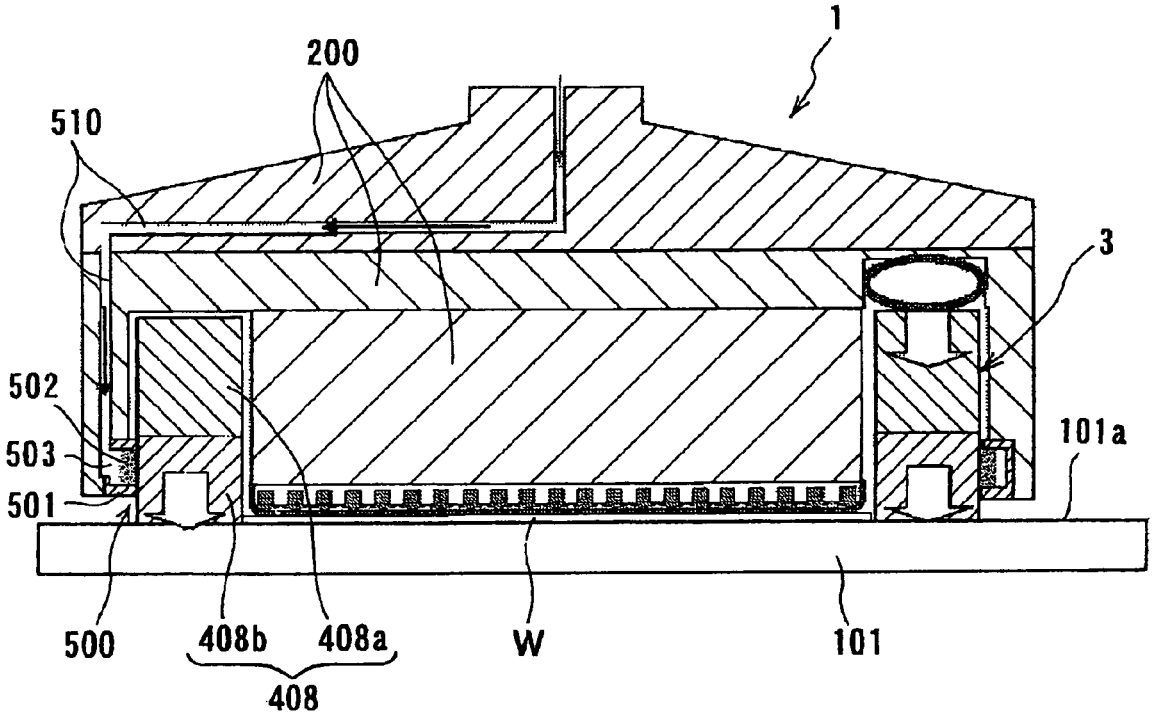
FIG. 11 is a schematic cross-sectional view showing a top ring according to another embodiment of the present invention.
Figure 12:
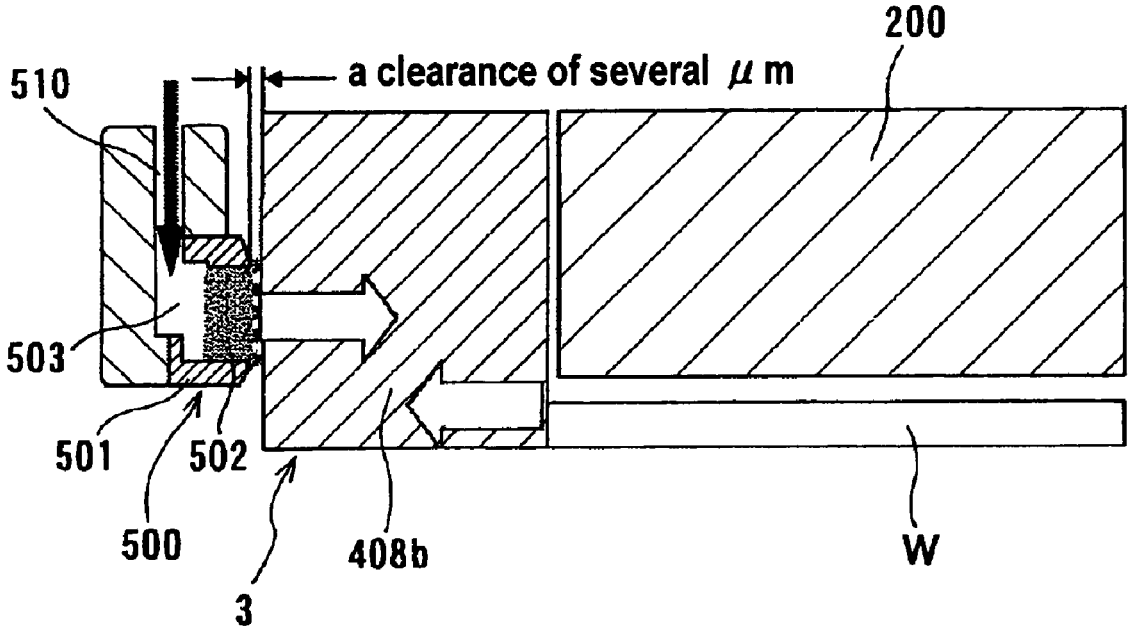
FIG. 12 is an enlarged view of a main part of FIG. 11.

FIG. 11 is a schematic cross-sectional view showing a top ring according to another embodiment of the present invention, and FIG. 12 is an enlarged view of a main part of FIG. 11. As shown in FIG. 11, in the top ring 1 according to this embodiment, the ring member 408 of the retainer ring 3 comprises an upper ring member 408*a* and a lower ring member 408*b*, and is supported by a fluid bearing 500 called an air bearing or the like. Specifically, the fluid bearing 500 fixed to a top ring body 200 is provided at an outer peripheral side of the ring member 408 of the retainer ring 3. The fluid bearing 500 comprises an annular housing 501 fixed to the top ring body 200, and a ring-shaped porous member 502 mounted in the housing 501. The porous member 502 is fixed to the housing 501 by adhesion, sintering or the like.

A passage 503 for supplying a pressurized fluid is formed in the housing 501, and the passage 503 is connected to a fluid supply source (not shown) through a passage 510 formed in the top ring body 200. Therefore, a pressurized fluid such as air or nitrogen gas is supplied to the porous member 502 through the passage 510 and the passage 503. The porous member 502 comprises metal such as copper, ceramics, or plastics, and has a number of voids (pores) formed therein. Thus, the pressurized fluid is supplied from the outer peripheral side to the inner peripheral side of the porous member 502 through these voids (pores). Therefore, a fluid film, such as an air film or a nitrogen gas film, having high load capability is formed between the ring member 408 and the porous member 502, and a lateral force applied to the ring member 408 is supported by the fluid film.

Specifically, the lateral force is applied to the ring member 408 of the retainer ring 3 by a frictional force between the semiconductor wafer and the polishing surface, but the lateral force is supported by the fluid film. Thus, a clearance of several μm can be maintained between the porous member 502 and the ring member 408. Therefore, the ring member 408 is vertically movable with no-sliding (noncontact) against the porous member 502, and hence the following capability of the ring member 408 with respect to the polishing surface can be remarkably enhanced. The porous member 502 is impregnated with solid lubricant such as Teflon (registered trademark), and even if the ring member 408 is brought into contact with the porous member 502 by any chance, the ring member 408 maintains excellent sliding characteristics.

Further, a temperature control device such as a cooler may be provided in the passage connecting the passage 510 and the fluid supply source to cool a pressurized fluid supplied from the fluid supply source. The temperature of the ring member 408 increases by friction heat between the ring member 408 and the polishing surface. However, the cooled pressurized fluid is blown on the outer circumferential surface of the ring member 408 from the porous member 502, thus cooling the ring member 408. Therefore, the temperature of the ring member 408 can be prevented from rising to suppress thermal expansion of the ring member 408. Thus, a clearance between the porous member 502 and the ring member 408 can be minimized, and the pressure of the fluid film formed between the porous member 502 and the ring member 408 can be increased to enhance the effect of the air bearing. Therefore, the ring member 408 is vertically movable with no-sliding (noncontact) against the porous member 502, and hence the following capability of the ring member 408 with respect to the polishing surface can be further enhanced.

Figure 13:
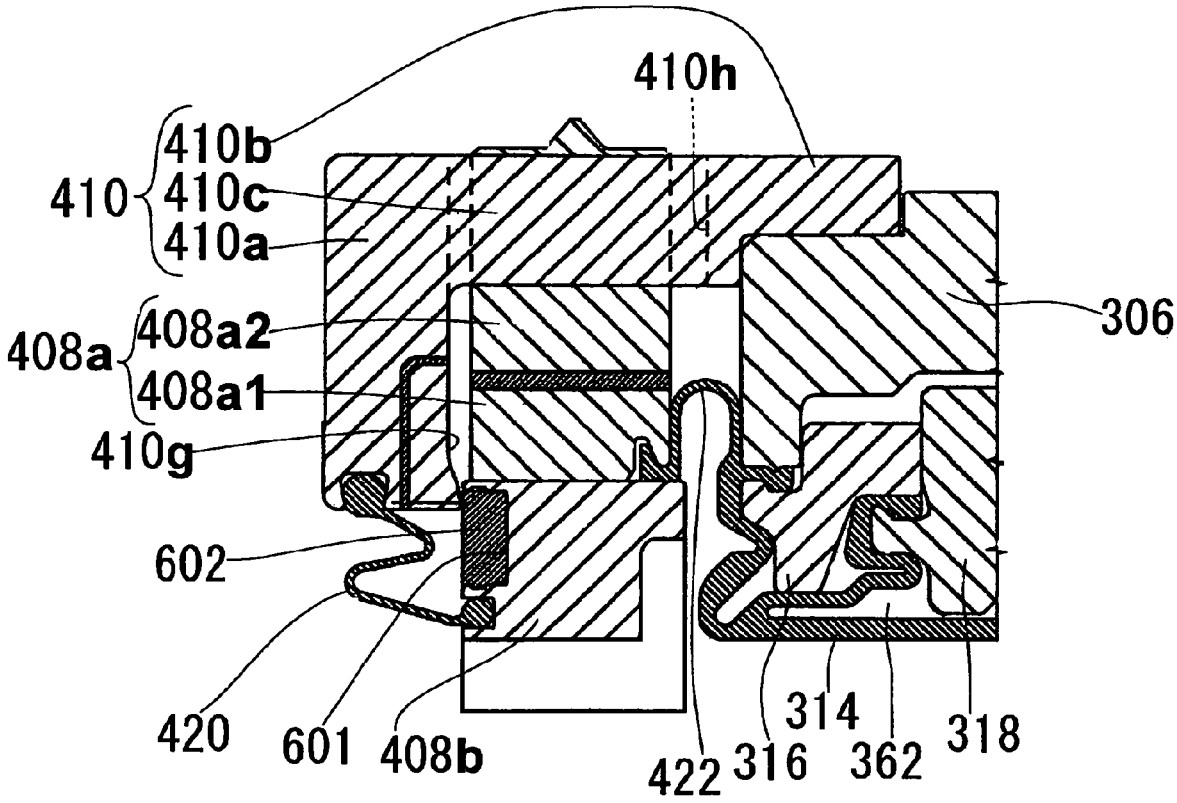
FIG. 13 is a cross-sectional view showing a retainer ring according to still another embodiment of the present invention, and is a view corresponding to FIG. 8.

Next, a retainer ring according to still another embodiment of the present invention will be described with reference to FIGS. 13 and 14. FIG. 13 is a cross-sectional view showing a retainer ring according to still another embodiment of the present invention. FIG. 13 is a view corresponding to FIG. 8. In the embodiment shown in FIG. 8, the thin metal ring 430 made of SUS or the like is fitted over the lower ring member 408*b* of the retainer ring 3, and the metal ring 430 is coated with a low friction material such as PTFE or PEEK•PPS.

In the embodiment shown in FIG. 13, a member comprising a low friction material is directly provided on the outer circumference of the lower ring member 408*b* of the retainer ring 3. Specifically, as shown in FIG. 13, a groove 601 having a substantially rectangular cross section is formed over an entire outer circumference of the lower ring member 408*b* of the retainer ring 3. A low friction material member 602 having a substantially rectangular cross section is fitted in the groove 601. The low friction material member 602 is made of a resin material such as polytetrafluoroethylene (PTFE) or PEEK•PPS. The resin material such as PTFE or PEEK•PPS is a low friction material having a low coefficient of friction, and has excellent sliding characteristics. The low friction material is defined as a material having a low coefficient of friction of 0.35 or less. It is desirable that the low friction material has a coefficient of friction of 0.25 or less.

Figure 14:
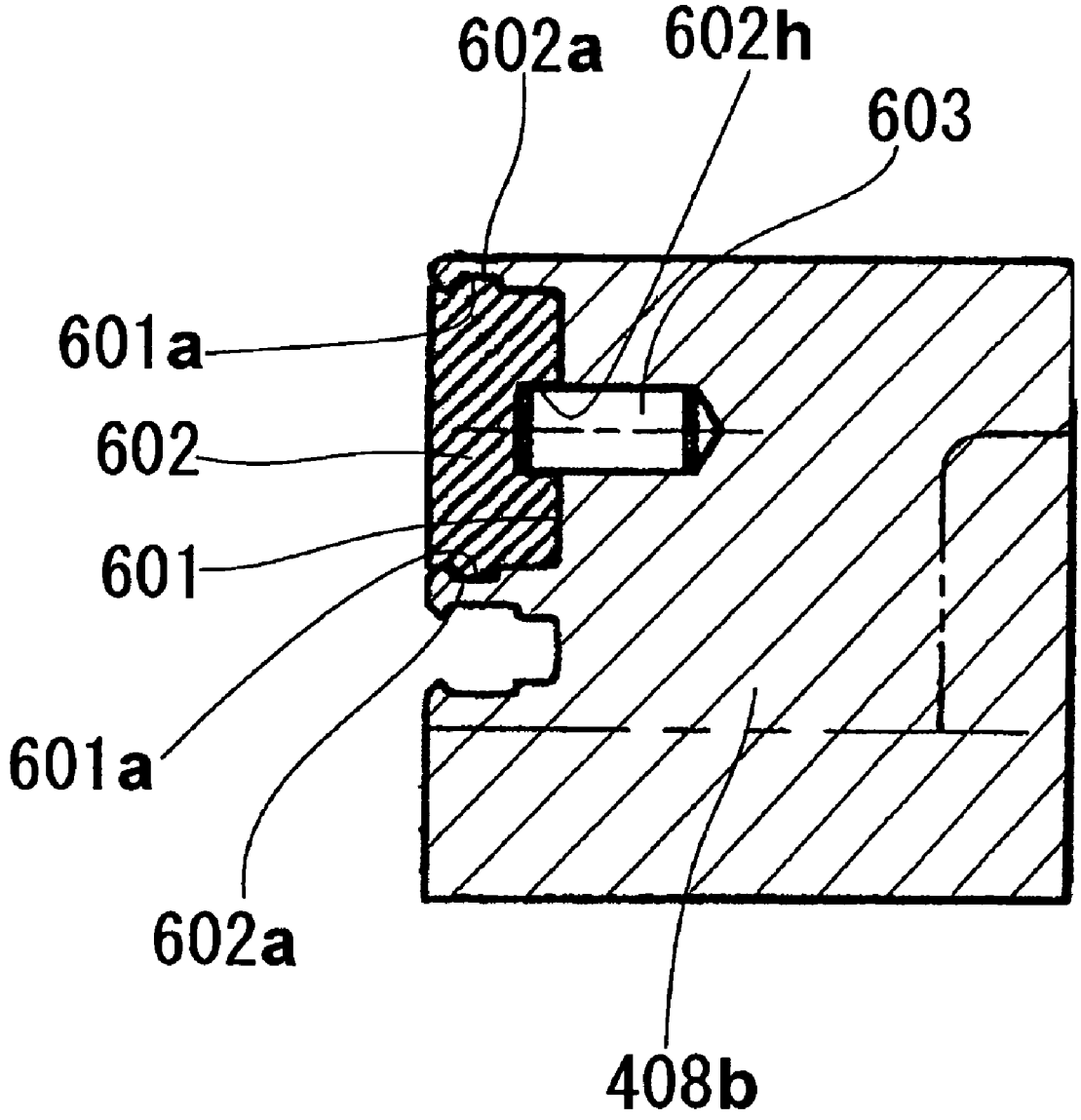
FIG. 14 is an enlarged view of a main part of FIG. 13 showing a fitting portion of a groove of a lower ring member and a low friction material member.

FIG. 14 is an enlarged view of a main part of FIG. 13 showing a fitting portion of the groove 601 of the lower ring member 408*b* and the low friction material member 602. FIG. 14 shows the state in which the connection sheet 420 is removed from the lower ring member 408*b*. As shown in FIG. 14, a recess 601*a* hollowed upwardly is formed in an upper inner surface of the groove 601 having a rectangular cross section of the lower ring member 408*b*, and a recess 601*a* hollowed downwardly is formed in a lower inner surface of the groove 601 having a rectangular cross section of the lower ring member 408*b*. A projection 602*a* bulged upwardly is formed in an upper outer surface of the low friction material member 602, and a projection 602*a* bulged downwardly is formed in a lower outer surface of the low friction material member 602. The upper and lower projections 602*a*, 602*a* of the low friction material member 602 are fitted in the upper and lower recesses 601*a*, 601*a* of the lower ring member 408*b* with no-clearance, respectively. Thus, the low friction material member 602 is prevented from dropping out of the lower ring member 408*b*. That is, the upper and lower projections 602*a*, 602*a* of the low friction material member 602 and the upper and lower recesses 601*a*, 601*a* of the lower ring member 408*b* constitute a retaining means for preventing the low friction material member 602 from dropping out of the lower ring member 408*b*. This retaining means may be composed of a recess formed in the low friction material member 602 and a projection formed on the lower ring member 408*b*. When the low friction material member 602 is mounted in the groove 601 of the lower ring member 408*b*, the projections 602*a*, 602*a* are deformable because the low friction material member 602 is made of a resin material, and hence the projections 602*a*, 602*a* are first deformed and then fitted into the recesses 601*a*, 601*a*, respectively. The projections 602*a*, 602*a* may be, mountain-shaped in whole and have a tapered surface at both ends, or may be circular arc in whole and have a curved surface at both ends.

Further, as shown in FIG. 14, a pin 603 is fixed into the bottom surface of the groove 601 of the lower ring member 408*b*, and a hole 602*h* is formed in the inner surface of the low friction material member 602. The forward end portion of the pin 603 is fitted into the hole 602*h* of the low friction material member 602. Thus, the low friction material member 602 is prevented from being rotated in a circumferential direction of the lower ring member 408*b*. Specifically, the pin 603 fixed into the groove 601 of the lower ring member 408*b*, and the hole 602*h* formed in the low friction material member 602 constitute a rotation-prevention means for preventing the low friction material member 602 from being rotated with respect to the lower ring member 408*b*. This rotation-prevention means may be composed of a projection formed in one of the groove 601 of the lower ring member 408*b* and the inner surface of the low friction material member 602 and a recess formed in the other of the groove 601 of the lower ring member 408*b* and the inner surface of the low friction material member 602.

The low friction material member 602 is composed of not a ring member but a belt-like member which is formed into a circular arc. Since the low friction material member 602 has flexibility, the low friction material member 602 may be first formed into a linear shape and then fitted into the groove 601 of the lower ring member 408*b* of the retainer ring 3 to become a circular arc corresponding to the circular arc of the retainer ring 3.

The low friction material member 602 has a substantially rectangular cross section. The projection 602*a* bulged upwardly is formed on the upper outer surface of the low friction material member 602, and the projection 602*a* bulged downwardly is formed on the lower outer surface of the low friction material member 602. As described above, the projections 602*a*, 602*a* are configured to be fitted into the recesses 601*a*, 601*a* of the lower ring member 408*b*, respectively. Further, the hole 602*h* is formed in the central portion of the low friction material member 602. As described above, the hole 602*h* is arranged such that the pin 603 fixed into the groove 601 of the lower ring member 408*b* is fitted into the hole 602*h*. A plurality of holes 602*h* to be fitted by the pins 603 may be formed.

The rotation-prevention means may be composed of a combination of a key and a key groove in place of the hole.

The low friction material member 602 may be composed of not a ring member but divided belt-like members, and these belt-like members may be fitted into the groove 601 of the lower ring member 408*b* of the retainer ring 3. For example, eight belt-like members whose both ends have a central angle (θ) of about 45° are fitted into the groove 601 of the lower ring member 408*b* of the retainer ring 3, and the entire circumference of the lower ring member 408*b* of the retainer ring 3 is covered with the low friction material member 602 comprising the eight belt-like members. When these eight belt-like members are fitted into the groove 601 of the lower ring member 408*b*, a small clearance is formed between the adjacent two belt-like members. This clearance is arranged to prevent the ends of the adjacent two belt-like members from coming into contact with each other, even if the belt-like members are thermally expanded due to temperature rise of the retainer ring 3 as polishing process progresses. The clearance is preferably in the range of about 0.1 mm to about 1 mm in view of thermal expansion coefficient of the low friction material member 602.

In the case where the low friction material member 602 is composed of a ring member, thermal expansion is repeated to form a radial clearance between the low friction material member 602 and the lower ring member 408*b*, and the low friction material member 602 becomes unfixed. However, since the low friction material member 602 is composed of not a ring member but the divided belt-like members, and a clearance is formed between the adjacent two belt-like members, a radial clearance is not formed between the low friction material member 602 and the lower ring member 408*b*.

The belt-like member is arranged such that both ends of the belt-like member have a central angle (θ) of about 45°. The central angle (θ) of the belt-like member may be larger than 45° or smaller than 45° If the central angle (θ) of the belt-like member is large, the number of the belt-like members are reduced. If the central angle (θ) of the belt-like member is small, the number of the belt-like members are increased. The entire circumference of the lower ring member 408*b* of the retainer ring 3 can be covered with the low friction material member 602 by adjusting the number of the belt-like members. If the central angle (θ) of the member is small, such member is in the form of not belt but rectangular parallelepiped or block. The number of division of the low friction material member 602 (the number of segments) should be two or more, and it is desirable that the low friction material member 602 should be divided into equal segments.

The low friction material 602 may be composed of a ring member which is not devided.

On the other hand, the inner circumferential surface of the outer peripheral portion 410*a* of the retainer ring guide 410 constitutes a guide surface 410*g* which is brought into sliding contact with the low friction material member 602. The guide surface 410*g* has an improved surface roughness by mirror processing. The mirror processing is defined as a processing including polishing, lapping, and buffing.

As described above, the low friction material member 602 is fitted over an entire or substantially entire outer circumference of the lower ring member 408*b* of the retainer ring 3. The guide surface 410*g* of the retainer ring guide 410 has an improved surface roughness by mirror processing, and hence the sliding characteristics between the lower ring member 408*b* of the retainer ring 3 and the retainer ring guide 410 can be improved. Accordingly, the following capability of the ring member 408 with respect to the polishing surface can be remarkably enhanced, and a desired surface pressure of the retainer ring can be applied to the polishing surface.

Although certain preferred embodiments of the present invention have been shown and described in detail, it should be understood that various changes and modifications may be made therein without departing from the scope of the appended claims.

What is claimed is:

1. An apparatus for polishing a substrate, comprising:

a polishing table having a polishing surface;

a top ring body configured to hold and press a substrate against said polishing surface;

a retainer ring provided at an outer peripheral portion of said top ring body and configured to press said polishing surface; and a retainer ring guide fixed to said top ring body and configured to be brought into sliding contact with a ring member of said retainer ring to guide a movement of said ring member;

wherein a low friction material member is provided on an outer circumference of said ring member of said retainer ring to bring said low friction material member into sliding contact with said retainer ring guide.

2. The apparatus according to claim 1, wherein said low friction material member comprises a resin material comprising polytetrafluoroethylene (PTFE) or PEEK•PPS.

3. The apparatus according to claim 1, wherein said low friction material member is fitted onto an outer circumference of said ring member.

4. The apparatus according to claim 3, wherein said low friction material member comprises a flexible member; and said low friction material member is mounted on said ring member to become a circular shape corresponding to an outer circumference of said ring member.

5. The apparatus according to claim 3, further comprising a retaining device provided at a location where said low friction material member is fitted onto said ring member and configured to prevent said low friction material member from dropping out of said ring member.

6. The apparatus according to claim 1, wherein said low friction material member comprises a belt-like or block-like member having both ends.

7. The apparatus according to claim 6, wherein a plurality of said belt-like or block-like members are provided on an outer circumference of said ring member in such a manner that a clearance is formed between the adjacent belt-like or block-like members.

8. The apparatus according to claim 1, further comprising a rotation-prevention device configured to prevent said low friction material member from being rotated with respect to said ring member.

* * * * *